US009672774B2

(12) United States Patent
Yang et al.

(10) Patent No.: US 9,672,774 B2
(45) Date of Patent: Jun. 6, 2017

(54) ELECTRONIC DISPLAY DEVICE AND BACKLIGHT ADJUSTMENT METHOD THEREOF

(71) Applicant: Wistron Corp., New Taipei (TW)

(72) Inventors: Chia-Chi Yang, New Taipei (TW); Yung-Yen Chang, New Taipei (TW)

(73) Assignee: Wistron Corp., New Taipei (TW)

( * ) Notice: Subject to any disclaimer, the term of this patent is extended or adjusted under 35 U.S.C. 154(b) by 106 days.

(21) Appl. No.: 14/322,745

(22) Filed: Jul. 2, 2014

(65) Prior Publication Data

US 2015/0097819 A1 Apr. 9, 2015

(30) Foreign Application Priority Data

Oct. 8, 2013 (TW) ..... 102136285 A

(51) Int. Cl.
*G09G 5/10* (2006.01)
*G09G 3/34* (2006.01)

(52) U.S. Cl.
CPC ... *G09G 3/3406* (2013.01); *G09G 2320/0626* (2013.01); *G09G 2354/00* (2013.01); *G09G 2360/144* (2013.01)

(58) Field of Classification Search
CPC G09G 3/048; G09G 3/36; G09G 5/10; G09G 3/3406; G09G 2320/0626; G09G 2354/00; G09G 2360/144; G09F 9/33; H04N 9/68; H04N 5/235
See application file for complete search history.

(56) References Cited

U.S. PATENT DOCUMENTS

2007/0247414 A1* 10/2007 Roberts ..... F21K 9/00 345/102
2008/0192140 A1* 8/2008 Lee ..... G06F 3/14 348/362
2012/0260174 A1* 10/2012 Imaida ..... G11B 27/034 715/721
2012/0274809 A1* 11/2012 Yang ..... H04N 5/58 348/234

FOREIGN PATENT DOCUMENTS

TW 201243820 A1 11/2012

OTHER PUBLICATIONS

China Patent Office, Office Action, Patent Application No. 201310503647.1, May 30, 2016, China.
Taiwan Patent Office, Office Action, Patent Application Serial No. 102136285, Apr. 2, 2015, Taiwan.

* cited by examiner

*Primary Examiner* — Lun-Yi Lao
*Assistant Examiner* — Johny Lau

(57) ABSTRACT

The present disclosure provides an electronic display device including a backlight module, a light sensor, a storage device, an embedded controller, and a processing unit. The light sensor detects ambient light surrounding the electronic display device. The embedded controller controls intensity of the backlight module according to the ambient light and a brightness table of the storage device. The processing unit performs a basic input/output system to draw a brightness curve diagram according to the brightness table for users to adjust the curve of the brightness curve diagram during a boot process of the electronic display device and update the brightness table in the storage device according to the adjusted brightness curve diagram in response to a storing signal.

20 Claims, 6 Drawing Sheets

ELECTRONIC DISPLAY DEVICE AND BACKLIGHT ADJUSTMENT METHOD THEREOF

CROSS REFERENCE TO RELATED APPLICATIONS

This Application claims priority of Taiwan Patent Application No. 102136285, filed on Oct. 8, 2013, the entirety of which is incorporated by reference herein.

BACKGROUND OF THE INVENTION

Field of the Invention

The present invention relates to a backlight adjustment method applied to an electronic display device, and in particular to a backlight adjustment method provided for users to adjust backlight intensity during the boot process.

Description of the Related Art

Presently, mobile devices are highly developed and multi-functional. For example, handheld devices such as mobile phones and tablets are capable of conducting telecommunications, receiving and transmitting e-mails, maintaining social networks, managing contacts, and playing media. Hence, users can implement various applications on their mobile devices, such as a simple phone call, social network interaction, or commercial transaction.

Most of the current handheld devices include a display unit with a backlight module. The initial setting of the backlight intensity is often proportional to the ambient light, and users cannot adjust the backlight brightness values themselves, causing them inconvenience.

BRIEF SUMMARY OF THE INVENTION

A detailed description is given in the following embodiments with reference to the accompanying drawings.

The present disclosure provides an electronic display device. The electronic display device includes a backlight module, a light sensor, a storage device, an embedded controller, and a processing unit. The backlight module includes at least one light source. The light sensor is arranged to detect ambient light surrounding the electronic display device. The storage device is arranged to store a brightness table. The embedded controller is arranged to control intensity of the backlight module according to the ambient light and the brightness table. The processing unit is arranged to perform a basic input/output system, wherein the basic input/output system is arranged to draw a brightness curve diagram according to the brightness table for users to adjust the curve of the brightness curve diagram during a boot process of the electronic display device, and update the brightness table in the storage device according to the adjusted brightness curve diagram in response to a storing signal.

The present disclosure further provides an electronic display device. The electronic display device is arranged to perform a basic input/output system to draw a brightness curve diagram according to a brightness table stored in a storage device and arranged to control intensity of a backlight module for users to adjust the curve of the brightness curve diagram during the boot process. The basic input/output system further includes an insert function, a point-plotting function and a drawing function. The insert function is arranged to insert a blank diagram in an advanced page of a BIOS setup menu in the boot process. The point-plotting function is arranged to plot a plurality of points at a plurality of coordinates on the blank diagram according to a plurality of parameters of the brightness table. The drawing function is arranged to connect the adjacent points by a loop according to a plurality of slopes calculated by the basic input/output system for completing the curve of the brightness curve diagram.

The present disclosure further provides a backlight adjustment method applied to an electronic display device, wherein the electronic display device comprises a brightness table arranged to control a backlight module according to the ambient light surrounding the electronic display device. The backlight adjustment method includes: drawing a brightness curve diagram according to a brightness table by a basic input/output system for users to adjust a curve of the brightness curve diagram during the boot process of the electronic display device; adjusting the brightness curve diagram by the basic input/output system according to operation of users; and updating the brightness table stored in a storage device according to the adjusted brightness curve diagram in response to a storing signal.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
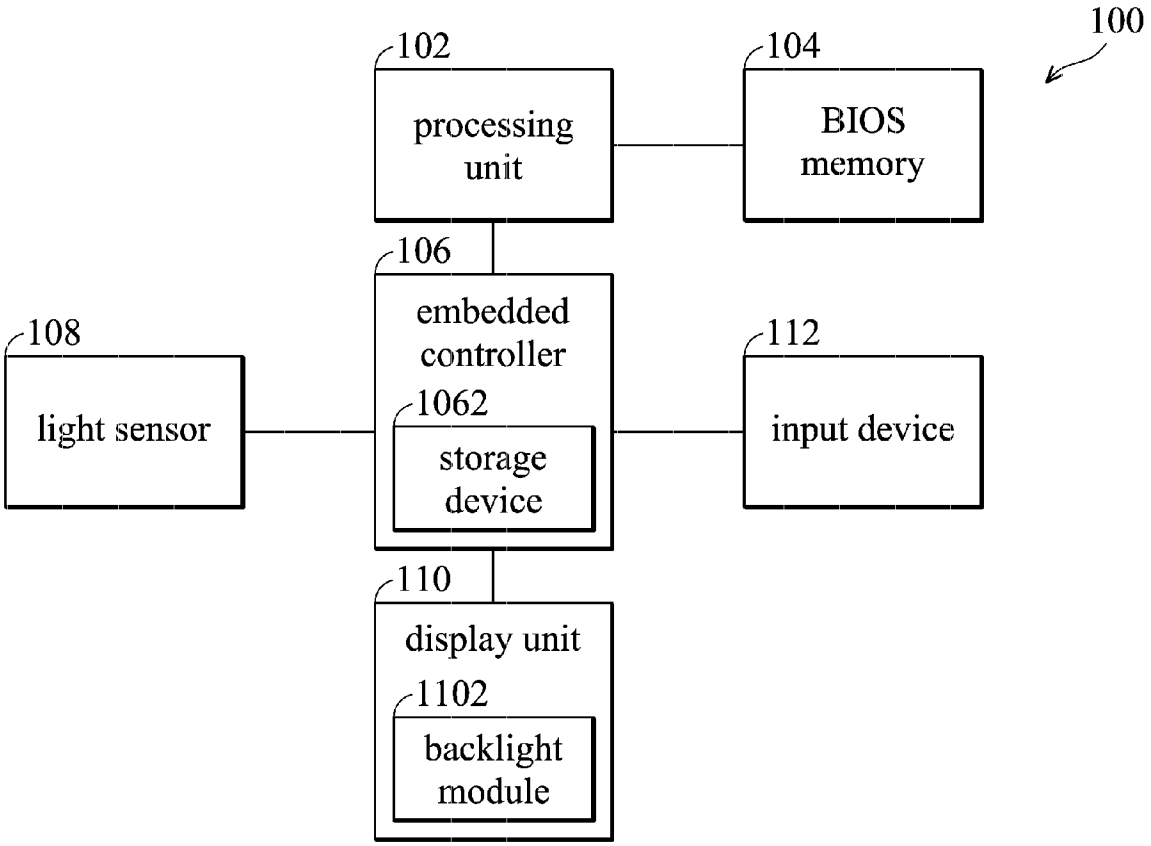
FIG. 1 is a schematic diagram illustrating an embodiment of an electronic display device of the present disclosure.

FIG. 1 is a schematic diagram illustrating an embodiment of an electronic display device of the present disclosure. The electronic display device 100 can be a note book, a smart phone, a PDA, etc., but it is not limited thereto. Those skilled in the art may implement the electronic display device 100 on a computer configuration having a backlight module, like hand-held devices, portable devices, personal digital assistants (PDA), microprocessor-based or programmable consumer electronics, etc. The electronic display device 100 includes a processing unit 102, a BIOS memory 104, an embedded controller 106, a light sensor 108, a display unit 110 and an input device 112.

The processing unit 102 may include a central-processing unit (CPU) or a plurality of processing units of a parallel processing environment. The memory may include a read only memory (ROM), a flash ROM and/or a random access memory (RAM), and the memory may be arranged to store the programs arranged to be performed by the processing unit. Generally, programs may include routines, applications, objects, components or Web Service elements. It should be noted that, in one of the embodiments, the processing unit 102 may further include a platform controller (not shown) coupled between the processor(s) of the processing unit 102 and other devices, like the BIOS memory 104 and the embedded controller 106. The platform controller is arranged to encode/decode data for the other devices and the processing unit 102, such that the processing unit 102 and the other devices can communicate with each other, and the platform controller is further arranged to determine the sequence of the programs performed by the processing unit 102 and transmit the commands of the processor(s) of the processing unit 102 to the electronic display device 100.

The BIOS memory 104 is arranged to store program code of a basic input/output system (BIOS), and provide the program code of the basic input/output system to the processing unit 102. For example, the BIOS memory 104 may be a Serial Peripheral Interface Read-Only Memory (SPI ROM), but it is not limited thereto. The BIOS memory 140 may be other non-volatile memories in other embodiments.

The embedded controller 106 is arranged to receive a detection signal produced by the light sensor 108 corresponding to the ambient light surrounding by the electronic display device 100 and the input signals produced by the input device 112 corresponding to the operation of the user. It should be noted that the embedded controller 106 further includes a storage device 1062 arranged to store a brightness table. Moreover, the embedded controller 170 is further arranged to find a corresponding backlight intensity from the brightness table according to the detection signal corresponding to the ambient light surrounding the electronic display device 100 to adjust the intensity of the light source(s) of the backlight module 1102. In another embodiment, the storage device 1062 may be implemented outside of the embedded controller 106, but it is not limited thereto.

The light sensor 108 is arranged to detect the ambient light surrounding the electronic display device 100, and produce a detection signal. Moreover, the light sensor 108 is further arranged to transmit the detection signal to the embedded controller 106.

The display unit 110 is arranged to display an image by at least one light source of a backlight module 1102. For example, the display unit 110 may be a Liquid Crystal Display (LCD). The backlight module 1102 may operate by an incandescent bulb, an electro-optical panel (ELP), a light-emitting diode (LED), or a cold cathode fluorescent tube (CCFL), but it is not limited thereto.

The input device 112 is arranged to produce input signals according to the operation of the user, and transmit the input signals to the embedded controller 106. It should be noted that, in other embodiments, the input device 112 may be coupled to the processing unit 102, and arranged to transmit the input signals to the processing unit 102, but it is not limited thereto. For example, the input device 112 may be a mouse, a keyboard, a touch panel and/or a touch pad, but it is not limited thereto.

In one of the embodiments, the basic input/output system is arranged to draw a brightness curve diagram according to the brightness table for users to adjust the curve of the brightness curve diagram during the boot process of the electronic display device 100, and update the brightness table in the storage device 1062 according to the adjusted brightness curve diagram in response to a storing signal. It should be noted that, in one embodiment, the basic input/output system of the electronic display device 100 is an Unified Extensible Firmware Interface (UEFI), wherein the boot process of the Unified Extensible Firmware Interface includes a Security (SEC) Phase, a Pre-EFI Initialization (PEI) Phase, a Driver Execution Environment (DXE) Phase, Boot Device Selection (BDS) Phase and a Transient System Load (TSL) Phase. In this embodiment, the basic input/output system is arranged to draw the brightness curve diagram according to the brightness table and provide the brightness curve diagram to users to adjust during the Driver Execution Environment (DXE) Phase of the Unified Extensible Firmware Interface.

For example, the basic input/output system includes an insert function, a point-plotting function and a drawing function to draw the brightness curve diagram according to the brightness table. The insert function (EFI_HII_IMAGE_PROTOCOL.NEWImage( )) is arranged to insert a blank diagram in the Driver Execution Environment (DXE) Phase of the boot process, wherein the blank diagram is inserted in an advanced page of a BIOS setup menu in the DXE Phase of the boot process, whereby the user may update the values of the brightness table on the said blank diagram in the advanced page. For example, the blank diagram can be a coordinate chart having a horizontal axis and a vertical axis with 100 scales, wherein the horizontal axis and the vertical axis represent the intensity of ambient light of the electronic display device 100 and the intensity of the backlight module 1102, respectively. The pointplotting function (EFI_HII_IMAGE_PROTOCOL. DrawLmage( )) is arranged to plot a plurality of points according to a plurality of parameters of the brightness table. For example, the brightness table includes 100 levels of intensity of ambient light, wherein each of the levels of intensity of ambient light has a corresponding level of intensity for the backlight module 1102. Therefore, each of the levels of intensity of ambient light and the corresponding level of intensity of the backlight module 1102 construct a coordinate chart. The drawing function (Drawlmage( )method) is arranged to connect the adjacent points by a loop according to a plurality of slopes calculated by the basic input/output system for completing the curve of the brightness curve diagram, wherein the brightness curve diagram has a horizontal axis and a vertical axis, and each of the slopes calculated by the basic input/output system is generated by two adjacent points on the brightness curve diagram. Moreover, the horizontal axis represents the ambient light received by the light sensor 108, and the vertical axis represents the intensity of the light source of the backlight module 1102. It should be noted that when the electronic display device 100 enters the DXE Phase of the boot process, the basic input/output system loads the brightness table into the system memory of the processing unit 102 from the storage device 1062.

Figure 2:
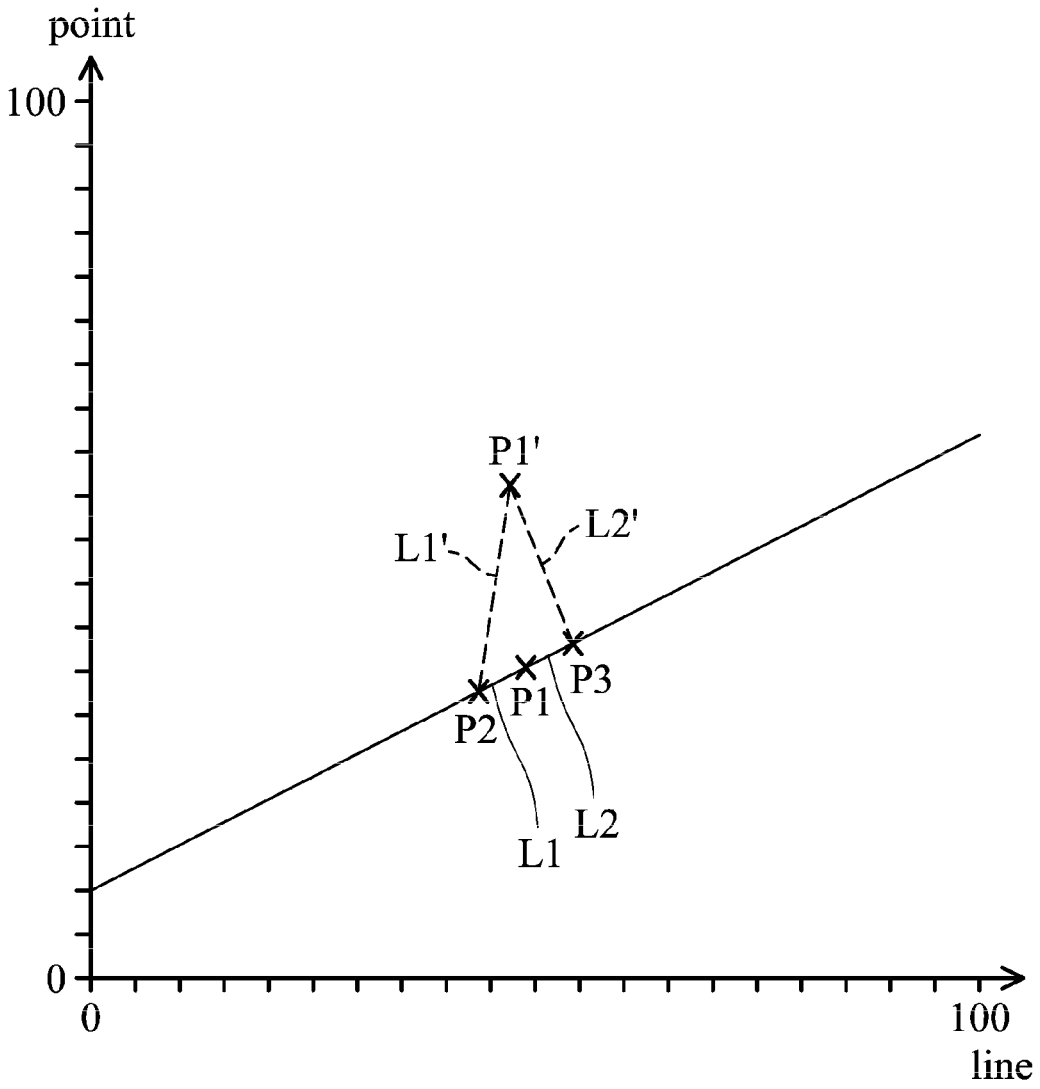
FIG. 2 is a schematic diagram of a brightness curve diagram according to an embodiment of the present disclosure.

Moreover, the basic input/output system further includes a cleaning function, wherein the cleaning function, the point-plotting function and the drawing function may adjust the curve of the brightness curve diagram according to the input signal (through the operation of the user) produced by the input device 112. For example, the cleaning function (EFI_HII_AIBT_CLEAR_IMAGES is arranged to clear a first line between a first point selected by the user and a second point and/or a second line between the first point and a third point, wherein the second point and the third point are adjacent to the first point. Namely, the cleaning function is arranged to clear the curves of the line on the two sides of the point selected by the user. The point-plotting function is further arranged to plot an adjusted first point according to the operation of the user for replacing the first point. The drawing function is further arranged to draw a first adjusted line between the adjusted first point and the second point and/or a second adjusted line between the adjusted first point and the third point. It should be noted that when the point selected by the user is the maximum or minimum value of the ambient light, the selected point has only one adjacent point and only one line between the adjacent point and the selected point. For example, as shown in FIG. 2, users may use the input device 112, like a mouse or a touch panel, to select a first point P1 corresponding to a first intensity of the ambient light, and drag the selected first point P1 up, down, to the left or to the right for updating the first point P1 by an adjusted first point P1' and changing the intensity value corresponding to the first intensity of the ambient light of the backlight module 1102. At this time, the cleaning function clears the first coordinate P1 selected by the user, a first line L1 between the first point P1 selected by the user and a second point P2 and a second line L2 between the first point P1 and a third point P3, wherein the second point P2 and the third point P3 are adjacent to the first point P1. Next, the point-plotting function draws an adjusted first point P1' according to the above operation of the user. The drawing function is arranged to draw an adjusted first line L1' between the adjusted first point P1' and the second point P2 and a second adjusted line L2' between the adjusted first point and the third point P3. It should be noted that lines between points may be straight or curved, but it is not limited thereto.

In another embodiment, the basic input/output system further includes a review function (EFI_HII_IMAGE_PROTOCOL.GetImage( ))arranged to check whether the blank diagram has a curve before the point-plotting function is performed, wherein the basic input/output system enables the point-plotting function when the review function determines that the blank diagram has no curve, and the review function produces an error signal when the review function determines that the blank diagram has at least one curve.

Moreover, in one of the embodiments, users may select the store button of the advanced page by the input device 112 to store the adjusted brightness curve diagram after finishing adjustments to the brightness curve diagram. The basic input/output system is further arranged to write a predetermined value into a flag of the storage device 1062 when the input device 112 receives the storing signal. It should be noted that the embedded controller 106 is further arranged to read the flag when the boot process exits the BIOS setup menu, and the embedded controller 106 updates the brightness table stored in the storage device 1062 according to the adjusted curve of the brightness curve diagram when the embedded controller 106 reads that the value of the flag is the predetermined value.

Figure 3:
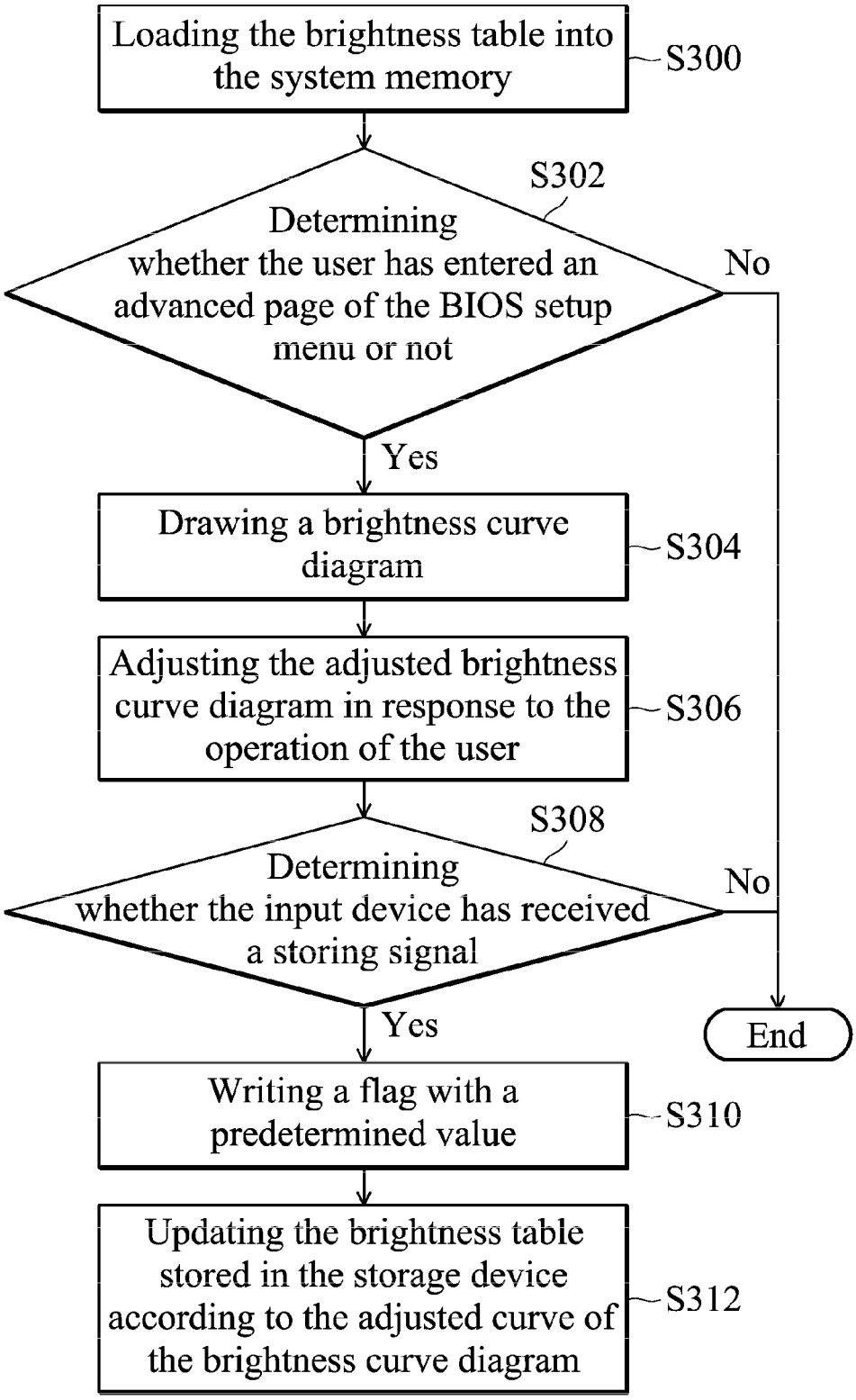
FIG. 3 is a flowchart of a backlight adjustment method according to an embodiment of the present disclosure.

FIG. 3 is a flowchart of a backlight adjustment method according to an embodiment of the present disclosure. The backlight adjustment method is applied to the electronic display device 100 of FIG. 1. The process starts at step S300.

In step S300, when the electronic display device 100 enters the boot process, the basic input/output system loads the brightness table into the system memory of the processing unit 102 from the storage device 1062.

Next, in step S302, the basic input/output system enters a Driver Execution Environment phase and determines whether the user has entered an advanced page of the BIOS setup menu or not. When the user enters the advanced page, the process goes to step S304, otherwise, the process ends at step S302.

In step S304, the basic input/output system draws a brightness curve diagram according to the brightness table for users to adjust the curve of the brightness curve diagram.

Next, in step S306, the basic input/output system adjusts the adjusted brightness curve diagram in response to the operation of the user. It should be noted that, in one embodiment, the basic input/output system of the electronic display device 100 is an Unified Extensible Firmware Interface (UEFI), wherein the boot process of the Unified Extensible Firmware Interface includes a Security (SEC) Phase, a Pre-EFI Initialization (PEI) Phase, a Driver Execution Environment (DXE) Phase, a Boot Device Selection (BDS) Phase and a Transient System Load (TSL) Phase. In this embodiment, the basic input/output system is arranged to draw the brightness curve diagram according to the brightness table and provide the brightness curve diagram to users to adjust during the DXE Phase of the Unified Extensible Firmware Interface.

Next, in step S308, the basic input/output system determines whether the input device 112 has received a storing signal corresponding to update the brightness table according to the adjusted brightness curve diagram. When the input device 112 receives the storing signal, the process goes to step S310, otherwise, the process ends at step S308.

In step S310, the basic input/output system writes the flag of the storage device 1062 with a predetermined value.

Next, in step S312, when the boot process exits the BIOS setup menu, the embedded controller 106 is further arranged to read the flag, and when the embedded controller 106 reads that the value of the flag is the predetermined value, the embedded controller 106 updates the brightness table stored in the storage device 1062 according to the adjusted curve of the brightness curve diagram.

Figure 4:
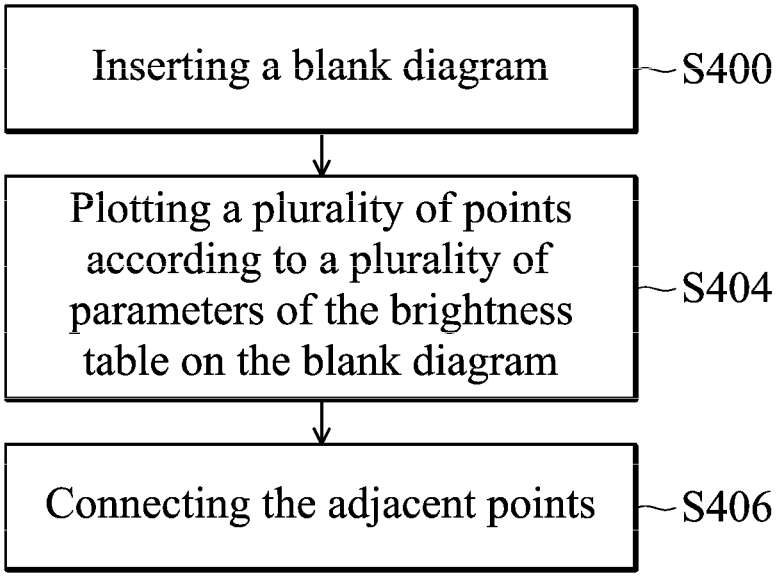
FIG. 4 is a flowchart of a method for drawing the brightness curve diagram according to an embodiment of the present disclosure.

FIG. 4 is a flowchart of a method for drawing the brightness curve diagram according to an embodiment of the present disclosure. The method of drawing the brightness curve diagram is applied to the electronic display device 100 of FIG. 1. The process starts at step S400.

In step S400, the insert function (EFI_HII_IMAGE_PROTOCOL.NEWImage( )) of the basic input/output system is arranged to insert a blank diagram in the Driver Execution Environment (DXE) Phase of the boot process, wherein the blank diagram is inserted into an advanced page of a BIOS setup menu in the Driver Execution Environment (DXE) Phase of the boot process. For example, the blank diagram can be a coordinate chart having a horizontal axis and a vertical axis with 100 scales, wherein the horizontal axis and the vertical axis represent the intensity of ambient light of the electronic display device 100 and the intensity of the backlight module 1102, respectively.

In step S404, the point-plotting function (EFI_HII_IMAGE_PROTOCOL.DrawLmage( )) is arranged to plot a plurality of points according to a plurality of parameters of the brightness table on the blank diagram. For example, the brightness table includes 100 levels of the intensity of the ambient light, wherein each of the levels of the intensity of the ambient light has a corresponding level of intensity of the backlight module 1102. Therefore, each of the levels of intensity of the ambient light and the corresponding level of the intensity of the backlight module 1102 construct a coordinate chart.

In step S406, the drawing function (DrawImage( )method) is arranged to connect the adjacent points by a loop according to a plurality of slopes calculated by the basic input/output system for completing the curve of the brightness curve diagram, wherein the brightness curve diagram has a horizontal axis and a vertical axis, wherein the horizontal axis represents the ambient light received by the light sensor 108, and the vertical axis represents the intensity of the light source of the backlight module 1102. The process ends at step S406.

Figure 5:
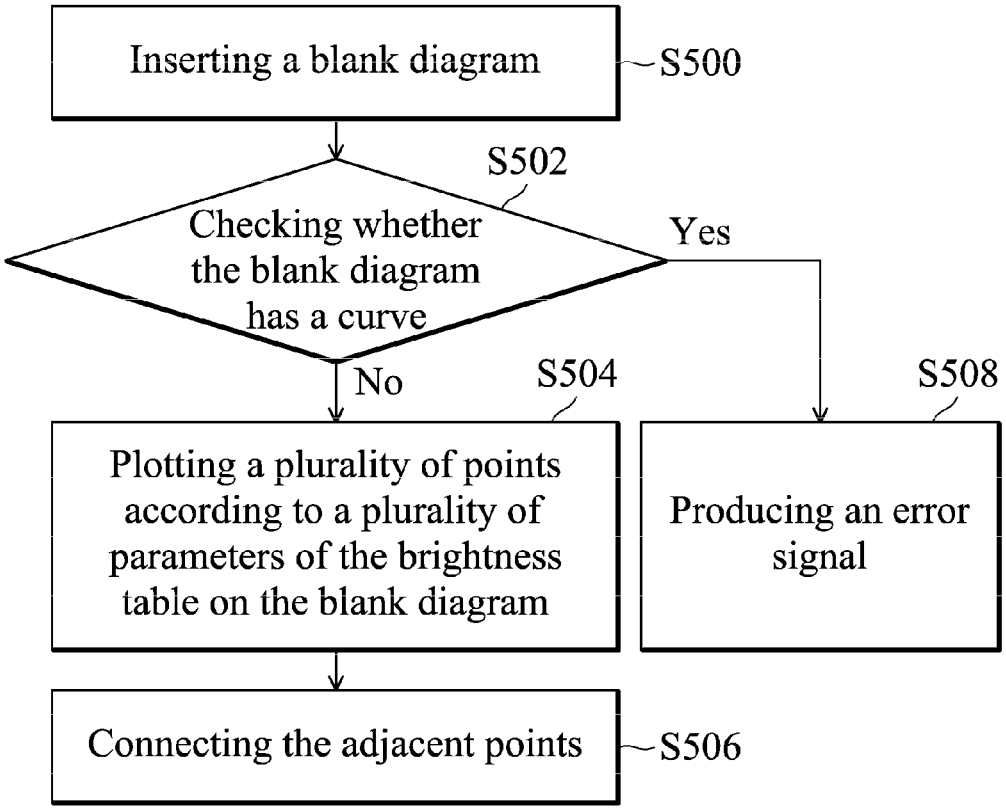
FIG. 5 is a flowchart of a method for drawing the brightness curve diagram according to another embodiment of the present disclosure.

FIG. 5 is a flowchart of a method for drawing the brightness curve diagram according to another embodiment of the present disclosure. The method of drawing the brightness curve diagram is applied to the electronic display device 100 of FIG. 1. The process starts at step S500. It should be noted that the method of drawing the brightness curve diagram of FIG. 5 is similar to the method of FIG. 4 except that the method of FIG. 5 further includes steps S502 and S508. Therefore, the details of steps S500, S504 and S506 can be referred to in steps S400-S406 of FIG. 4.

In step S502, the review function (EFI_HII_IMAGE_ PROTOCOL.GetImage( )) is arranged to check whether the blank diagram has a curve before the point-plotting function is performed. When the review function determines that the blank diagram has no curve, the process goes to step S504, otherwise, the process goes to step S508.

In step S508, the basic input/output system produces an error signal. The process ends at step S508.

Figure 6:
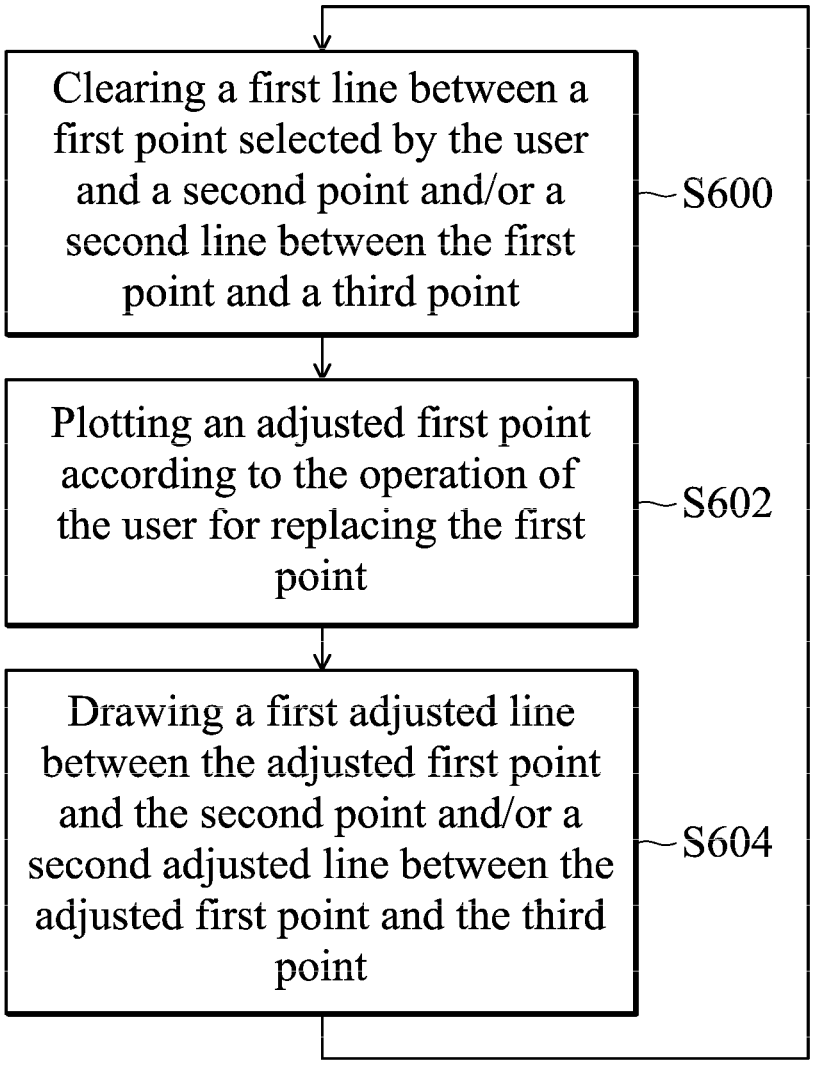
FIG. 6 is a flowchart of a method for adjusting the brightness curve diagram according to an embodiment of the present disclosure.

FIG. 6 is a flowchart of a method for adjusting the brightness curve diagram according to an embodiment of the present disclosure. The method of adjusting the brightness curve diagram is applied to the electronic display device 100 of FIG. 1. The process starts at step S600.

In step S600, the cleaning function (EFI_HII_AIBT-_CLEAR_ IMAGES) is arranged to clear a first line between a first point selected by the user and a second line between the first point and a second point and/or a second line between the first point and a third point, wherein the second point and the third point are adjacent to the first point. Namely, the cleaning function is arranged to clear the curves of the line on the two sides of the point selected by the user. For example, as shown in FIG. 2, users may use the input device 112, like a mouse or a touch panel, to select a first point P1 corresponding to a first intensity of the ambient light.

Next, in step S602, the point-plotting function is further arranged to plot an adjusted first point according to the operation of the user for replacing the first point. For example, as shown in FIG. 2, the user may use the input device 112, like a mouse or a touch panel, to drag the selected first point P1 up, down, to the left or to the right for updating the first point P1 by an adjusted first point P1' to change the intensity value corresponding to the first intensity of the ambient light of the backlight module 1102.

Next, in step S604, the drawing function is further arranged to draw a first adjusted line between the adjusted first point and the second point and/or a second adjusted line between the adjusted first point and the third point. Next, the process returns to step S600, wherein the basic input/output system continuous to adjust the curve of the brightness curve diagram.

The electronic display device and the backlight adjustment method can provide the interface for users to adjust the intensity of the backlight module 1102 during the boot process.

Data transmission methods, or certain aspects or portions thereof, may take the form of a program code (i.e., executable instructions) embodied in tangible media, such as floppy diskettes, CD-ROMS, hard drives, or any other machine-readable storage medium, wherein, when the program code is loaded into and executed by a machine such as a computer, the machine thereby becomes an apparatus for practicing the methods. The methods may also be embodied in the form of a program code transmitted over some transmission medium, such as electrical wiring or cabling, through fiber optics, or via any other form of transmission, wherein, when the program code is received and loaded into and executed by a machine such as a computer, the machine becomes an apparatus for practicing the disclosed methods. When implemented on a general-purpose processor, the program code combines with the processor to provide a unique apparatus that operates analogously to application-specific logic circuits.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic display device, comprising:

a backlight module, comprising at least one light source;

a light sensor, arranged to detect ambient light surrounding the electronic display device;

a storage device, arranged to store a brightness table;

an embedded controller, arranged to control intensity of the backlight module according to the ambient light and the brightness table; and a processing unit, arranged to perform a basic input/output system, wherein the basic input/output system is arranged to draw a brightness curve diagram according to the brightness table for users to adjust a curve of the brightness curve diagram during a boot process of the electronic display device, and update the brightness table in the storage device according to the adjusted brightness curve diagram in response to a storing signal, wherein the basic input/output system further comprises:

an insert function, arranged to insert a blank diagram in an advanced page of a BIOS setup menu during the boot process;

a review function, arranged to check whether the blank diagram has a curve; and a point-plotting function, arranged to plot a plurality of points at a plurality of coordinates on the blank diagram according to a plurality of parameters of the brightness table, wherein the basic input/output system enables the point-plotting function and draws the brightness curve diagram when the review function determines that the blank diagram has no curve.

2. The electronic display device as claimed in claim 1, wherein the storage device is implemented in the embedded controller.

3. The electronic display device as claimed in claim 2, further comprising an input device arranged to produce a plurality of input signals, wherein the input signals comprise the storing signal, and the basic input/output system is further arranged to write a predetermined value in a flag of the storage device when the input device receives the storing signal.

4. The electronic display device as claimed in claim 3, wherein the basic input/output system further comprises:

a drawing function, arranged to connect the adjacent points by a loop according to a plurality of slopes calculated by the basic input/output system for completing the curve of the brightness curve diagram.

5. The electronic display device as claimed in claim 4, wherein the basic input/output system further comprises a cleaning function arranged to clear a first line between a first point selected by a user and a second point and/or a second line between the first point and a third point, wherein the second point and the third point are adjacent to the first point, the point-plotting function is further arranged to plot an adjusted first point according to operation of users for replacing the first point, and the drawing function is further arranged to draw a first adjusted line between the adjusted first point and the second point and/or a second adjusted line between the adjusted first point and the third point.

6. The electronic display device as claimed in claim 5, wherein the step of checking whether the blank diagram has a curve by the review function is performed before the point-plotting function is performed, wherein the basic input/output system enables the point-plotting function to draw the brightness curve diagram when the review function determines that the blank diagram has no curve, and the review function produces an error signal when the review function determines that the blank diagram has at least one curve.

7. The electronic display device as claimed in claim 4, wherein the brightness curve diagram has a horizontal axis and a vertical axis wherein the horizontal axis represents intensity of the ambient light received by the light sensor, and the vertical axis represents intensity of the light source of the backlight module.

8. The electronic display device as claimed in claim 4, wherein when the boot process exits the BIOS setup menu, the embedded controller is further arranged to read the flag, and when the embedded controller reads that the value of the flag is the predetermined value, the embedded controller updates the brightness table in the storage device according to the adjusted brightness curve diagram in response to a storing signal.

9. A electronic display device, arranged to perform a basic input/output system to draw a brightness curve diagram according to a brightness table stored in a storage device and arranged to control intensity of a backlight module for users to adjust the curve of the brightness curve diagram during the boot process, wherein the basic input/output system further comprises:

an insert function, arranged to insert a blank diagram in an advanced page of a BIOS setup menu in the boot process;

a point-plotting function, arranged to plot a plurality of points at a plurality of coordinates on the blank diagram according to a plurality of parameters of the brightness table;

a drawing function, arranged to connect the adjacent points by a loop according to a plurality of slopes calculated by the basic input/output system for completing the curve of the brightness curve diagram; and a review function arranged to check whether the blank diagram has a curve before the point-plotting function is performed, wherein the basic input/output system enables the point-plotting function when the review function determines that the blank diagram has no curve.

10. The electronic display device as claimed in claim 9, wherein the basic input/output system further comprises a cleaning function arranged to clear a first line between a first point selected by a user and a second point and/or a second line between the first point and a third point, wherein the second point and the third point are adjacent to the first point, the point-plotting function is further arranged to plot an adjusted first point according to the operation of the user for replacing the first point, and the drawing function is further arranged to draw a first adjusted line between the adjusted first point and the second point and/or a second adjusted line between the adjusted first point and the third point.

11. The electronic display device as claimed in claim 10, wherein the review function produces an error signal when the review function determines that the blank diagram has at least one curve.

12. The electronic display device as claimed in claim 9, wherein the brightness curve diagram has a horizontal axis and a vertical axis, wherein the horizontal axis represents intensity of the ambient light received by the light sensor, and the vertical axis represents intensity of the light source of the backlight module.

13. A backlight adjustment method, applied to an electronic display device, wherein the electronic display device comprises a brightness table arranged to control a backlight module according to the ambient light surrounding the electronic display device, and the backlight adjustment method comprises:

drawing a brightness curve diagram according to a brightness table by a basic input/output system for users to adjust a curve of the brightness curve diagram during the boot process of the electronic display device, wherein the basic input/output system further comprises an insert function, a review function, and a point-plotting function, the step of drawing the brightness curve diagram further comprises:

inserting a blank diagram in an advanced page of a BIOS setup menu in the boot process by the insert function;

checking whether the blank diagram has a curve by the review function; and when the review function determines that the blank diagram has no curve, plotting a plurality of points at a plurality of coordinates on the blank diagram according to a plurality of parameters of the brightness table by the point-plotting function and drawing the brightness curve diagram by the basic input/output system;

adjusting the brightness curve diagram by the basic input/output system according to operation of users; and updating the brightness table stored in a storage device according to the adjusted brightness curve diagram in response to a storing signal.

14. The backlight adjustment method as claimed in claim 13, wherein the storage device is implemented in an embedded controller of the electronic display device.

15. The backlight adjustment method as claimed in claim 13, wherein the step of updating the brightness table stored in the storage device according to the adjusted brightness curve diagram further comprises:

determining whether a storing signal is received; and writing a predetermined value into a flag of the storage device by the basic input/output system when the storing signal is received.

16. The backlight adjustment method as claimed in claim 15, wherein the basic input/output system further comprises a drawing function, and the step of drawing the brightness curve diagram further comprises:

connecting the adjacent points by a loop according to a plurality of slopes calculated by the basic input/output system for completing the curve of the brightness curve diagram by the drawing function.

17. The backlight adjustment method as claimed in claim 16, wherein the basic input/output system further comprises a cleaning function, and the step of adjusting the brightness curve diagram further comprises:

clearing a first line between a first point selected by the user and a second point and/or a second line between the first point and a third point by the cleaning function, wherein the second point and the third point are adjacent to the first point;

plotting an adjusted first point according to operation of users for replacing the first point by the point-plotting function; and drawing a first adjusted line between the adjusted first point and the second point and/or a second adjusted line between the adjusted first point and the third point by the drawing function.

18. The backlight adjustment method as claimed in claim 17, wherein the step of drawing the brightness curve diagram further comprises:

enabling the point-plotting function by the basic input/output system when the review function determines that the blank diagram has no curve; and producing an error signal by the review function when the review function determines that the blank diagram has at least one curve.

19. The backlight adjustment method as claimed in claim 16, wherein the brightness curve diagram has a horizontal axis and a vertical axis, wherein the horizontal axis represents intensity of the ambient light received by the light sensor, and the vertical axis represents intensity of the light source of the backlight module.

20. The backlight adjustment method as claimed in claim 16, wherein the step of updating the brightness table stored in the storage device according to the adjusted brightness curve diagram further comprises:

reading the flag when the boot process exits the BIOS setup menu;

updating the brightness table in the storage device according to the adjusted brightness curve diagram when the value of the flag is the predetermined value.

* * * * *